United States Patent [19]

Brandhuber

[11] Patent Number: 4,758,016

[45] Date of Patent: Jul. 19, 1988

[54] DEVICE TO FASTEN A CROSS-COUNTRY SKI BOOT ON A CROSS-COUNTRY SKI

[75] Inventor: Alfred Brandhuber, Bad Ischl, Austria

[73] Assignee: TMC Corporation, Switzerland

[21] Appl. No.: 929,855

[22] PCT Filed: Feb. 21, 1986

[86] PCT No.: PCT/EP86/00085

§ 371 Date: Oct. 22, 1986

§ 102(e) Date: Oct. 22, 1986

[87] PCT Pub. No.: WO86/04825

PCT Pub. Date: Aug. 28, 1986

[30] Foreign Application Priority Data

Feb. 22, 1985 [AT] Austria ..... 532/85
Sep. 5, 1985 [AT] Austria ..... 2590/85

[51] Int. Cl.[4] ..... A63C 9/00

[52] U.S. Cl. ..... 280/615; 280/624; 280/636

[58] Field of Search ..... 280/614, 615, 624, 633, 280/635, 636

[56] References Cited

U.S. PATENT DOCUMENTS 4,262,925 4/1981 Plenk ..... 280/615
4,309,833 1/1982 Salomon ..... 280/615
4,410,199 10/1983 Eisenberg ..... 280/615
4,498,687 2/1985 Salomon et al. ..... 280/615

FOREIGN PATENT DOCUMENTS 0035613 9/1981 European Pat. Off. .
2633373 2/1978 Fed. Rep. of Germany .
2907359 8/1980 Fed. Rep. of Germany .
3315641 11/1983 Fed. Rep. of Germany .
841238 5/1939 France .
2381535 9/1978 France .
2525908 11/1983 France ..... 280/615
2537011 6/1984 France .
596856 3/1978 Switzerland .

*Primary Examiner*—David M. Mitchell
*Assistant Examiner*—Brian L. Johnson
*Attorney, Agent, or Firm*—Lorusso & Loud

[57] ABSTRACT

A cross-country ski binding in which the shoe (2) is attached to the ski (7) by means of a device with a binding component (3) which permits the foot to swing laterally about an axis (1) which is diagonal to the forward movement of the ski. The axis of movement runs through a point on the inner side of the ski (4) which is relatively far from the ski point (8) and through a point on the outer side of the ski (5) which is nearer to the ski point (8). Thus the pivoting axis (1) is preferably located beneath the hypothetical axis of rotation (6) of the metatarsophalangeal joints, rising towards the outside by an angle between 5° and 20° from the upper surface of the ski.

13 Claims, 4 Drawing Sheets

DEVICE TO FASTEN A CROSS-COUNTRY SKI BOOT ON A CROSS-COUNTRY SKI

The invention concerns a device, which includes a binding element, to fasten a cross-country ski booth on a cross-country ski. By means of this device, the foot can be pivoted about an axis that runs diagonal to the long direction of the ski, in the course of the running motion.

Such a device is described, for instance, in the DE-OS No. 33 15 641 and is used to improve the trueness of the track of the cross-country ski in the course of conventional cross-country skiing in a diagonal step. For this purpose, the two pivoting axes of the pair of skis converge towards the front, i.e. their imagined intersection point lies closest to the tips of the skis. When the foot is raised in the diagonal step, where the motional sequence resembles that of a normal walking or running motion, the slanted pivoting axis causes the foot to be able to approximately follow the natural course of motion without exerting a torque on the ski that is running in the track or that is lifted from t at the rear. A slight slant of the sole of the foot towards the outside is not particularly bothersome here.

An outwardly tilting pivoting motion displaces the toes outward, the heel somewhat inward, and the knee somewhat outward. Such a displacement of the parts of the body, however, is contrary to the anatomically based course of motion in a skating step, such as must also be used according to conventional cross-country technique. In the push-off phase, an outwardly tilting motion of the foot is extremely unfavorable.

The invention now has the aim of creating a device of the type mentioned in the introduction, which accommodates the course of the motion especially in a one-sided or double-sided skating step.

According to the invention, this aim is now achieved by each axis running from an intersection point at the inside through a point on the outside which lies closer to the tip of the ski than the intersection point of the axes.

For the skating step, the main advantages of this arrangement lie in the inward pivoting of the turned-out leg and thus in the ergonomically more favorable position of the force application point, in an increase of the push-off pressure and/or an extension of the push-off phase, where the stress and the risks of injury for the joints at the foot, leg, and hip are simultaneously reduced. It is preferred that the axis runs at an angle between 5° and 20° to the ski surface. In this case, even in the conventional diagonal step, this arrangement of the pivoting axis causes a displacement of the heel inward, while the knee region essentially remains in the same position. Relative to the heel, the knee is therefore also displaced outwardly.

In a preferred embodiment, the axis runs in the region below the imagined rotation axis of the toe joints of a foot situated in a cross-country ski. The axis is primarily designed as a physical axle bolt.

This makes it unnecessary to design a boot with a sole that is matched to the roll-off motion of the foot, so that in further preferred embodiments, the sole of the cross-country ski boot can be designed roll-off-stiff and/or torsion-stiff. The roll-off-stiff design of the boot sole causes the toe joints and the associated musculature to be relieved of stress. In addition, the torsion stiffness causes a much better transfer of the lateral forces. The cross-country ski can be guided easier, and the previous assembly of guide plates and support plates on the ski can be omitted.

A binding element is required for fastening a boot onto a ski. Thus various possibilities arise for arranging the axis. In a first preferred possibility, the axis or the axle bolt runs through the sole of the cross-country ski boot, in which there is at least one boring which is flush with the axle. This design can be implemented especially easily if the sole is designed roll-off-stiff, since it can then be made in the necessary or arbitrary thickness. A thick boot sole is always an advantage because it reduces friction losses, both with an edge use in a skating step and in a deeper track with the diagonal step.

A second equivalent design provides that the axis or the axle bolt runs through the cross-country ski, in which there is at least one boring that is flush with the axis.

In a preferred embodiment the axle bolt protrudes from the boring on both sides and engages the binding element. A binding element suitable for fastening the axle bolt can be constructed very simply. For example, if U- or V-shaped recesses for the protrusion ends of the axle bolt are designed into the binding element, it is possible to think of it as being fastened by spring-tensioned locking pins, which close the U-shaped recesses after the axle bolt has been inserted. The axle bolt can be secured against twisting in the binding element by designing the protruding ends with an edge.

Furthermore, the axle bolt can consist of two semi-axles which are disposed in the binding element and which can be inserted into the boring. According to this design, it is only necessary to make one boring or two blind borings in the sole or in the ski while the semi-axles, for example, can be disposed or hinged in lateral guides of the binding element, and can be inserted or pivoted into the borings.

To limit the lift-off angle, a preferably adjustable strap can be provided at the binding element. Furthermore, an elastically compressible insert, generally wedge-shaped, can be provided in the pivoting space. This causes the angle limiting stop to be damped and facilitates the return into the base position. Furthermore, the elastically compressible insert keeps the ski in contact with the boot when the foot is raised.

Finally, it can also be advantageous if the axle can be disposed in several positions between the tip of the boot and the imagined rotation axis of the toe joints. Such a design is especially advantageous when larger distances are to be traversed partly or entirely in the diagonal step, whereby the accustomed positioning of the pivoting axis is achieved. In the case of the skating step, the center of the gravity of the boot is shifted through the axis which lies below the toe joints, so that the scoop of the ski is raised more easily. The invention is described below in terms of the figures in the enclosed drawings, without being limited thereto.

Figure 1:
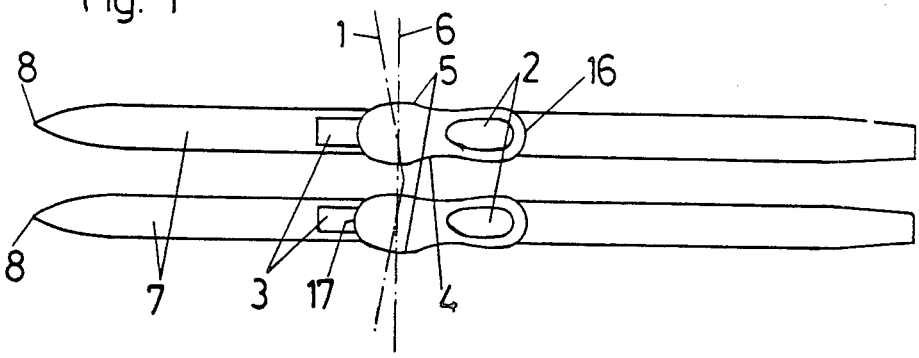
FIG. 1 shows a schematic top view of a pair of skis with the device according to the invention.
Figure 2:
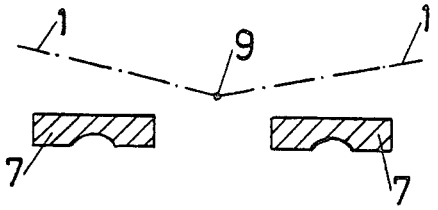
FIG. 2 shows the arrangement of the pivoting axle viewed in the running direction.
Figure 6:
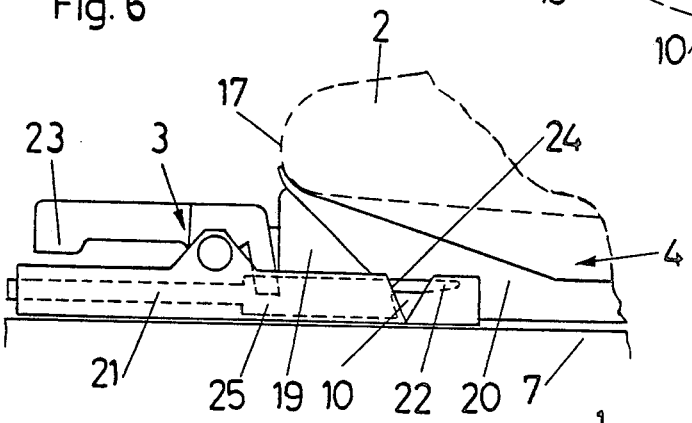
FIG. 6 shows a side view of the forward boot section with a binding element.
Figure 7:
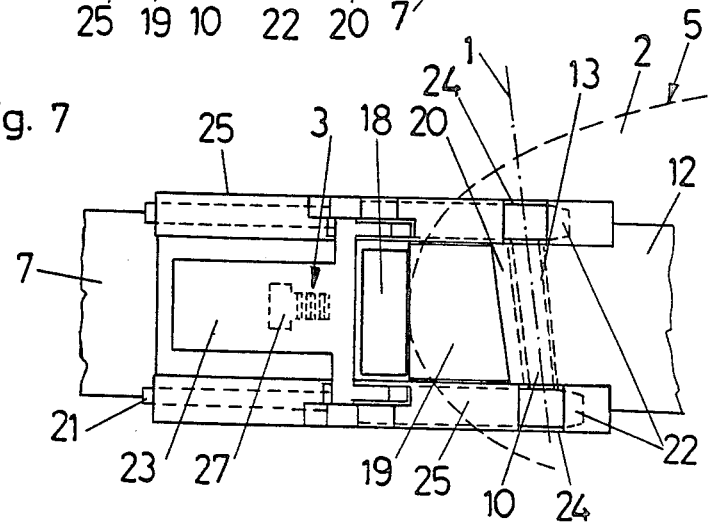
FIG. 7 shows a top view of the forward boot section with a binding element according to FIG. 6.

FIG. 1 shows a pair of cross-country skis 7 in a top view. Here, cross-country boots 2 are pivotably disposed about axles 1 in schematically arranged binding elements 3. As can be seen from FIG. 2, the imagined intersection point 9 of the two axes 1 lies between the insides 4 of the boots 2, and the two axes 1 rise slantwise to the outside 5, where every exterior point of the axes 1 lies closer to the tips 8 of the skis than their intersection point 9. The two axes 1 thus converge towards the rear and towards the bottom, and run in the region of the toe joints, whose imagined rotation axes are designated by 6. Conventional binding elements are mounted so that the toes of conventional cross-country boots lie approximately at the center of gravity in the middle of the ski. In the invented device, the toes 17 of the boots are displaced forward beyond the center of the skis. Since the lift-off motion of the heel 16 from the ski preferably is counteracted by an elastic, slightly compressible damping element 19 (FIGS. 6, 9, 11), the center of gravity in the cross-country ski 7 will be displaced somewhat towards the front, due to the displaced boot-toe 17. As a result, in the skating step, lifting the ski and especially the scoops at the end of the push-off phase is facilitated.

Figure 3:
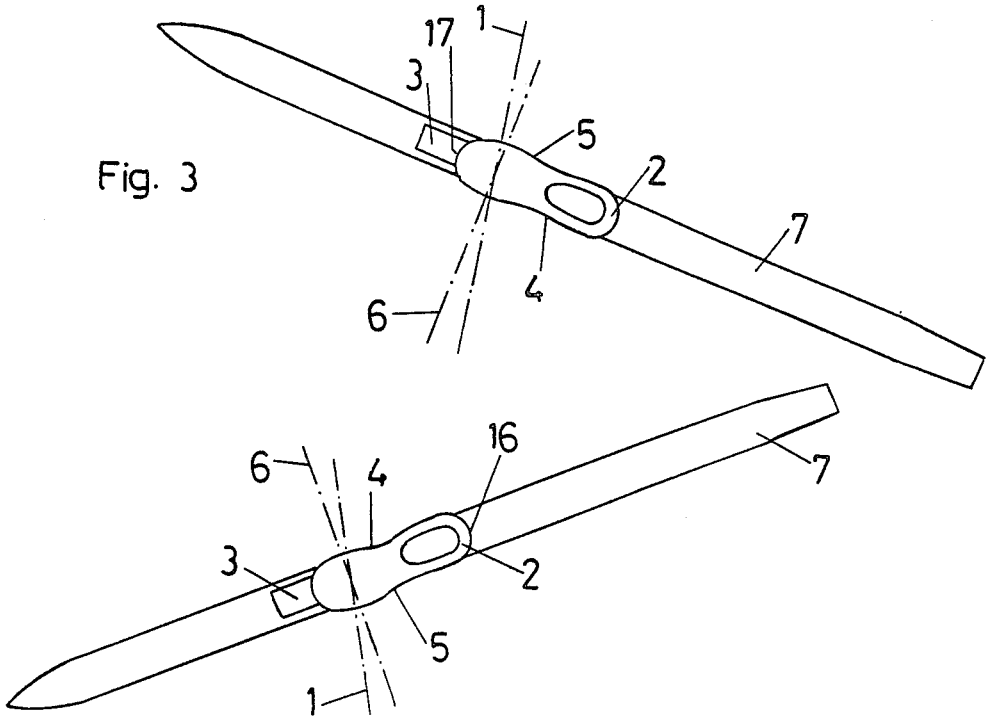
FIG. 3 shows a schematic top view of a pair of skis in the skating-step position.
Figure 4:
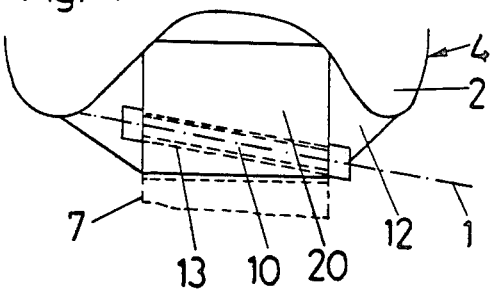
FIG. 4 shows a front view of a right cross-country ski of the first embodiment.
Figure 5:
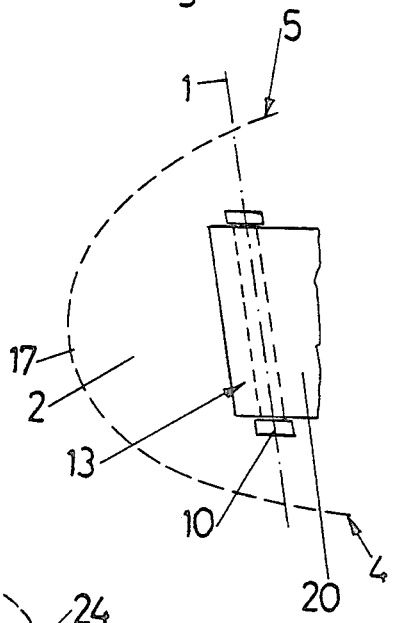
FIG. 5 shows a schematic top view of the forward boot section.

FIG. 3 shows a schematic top view of the pair of skis in a skating step. This figure shows that lifting the heel of the right foot from the ski, while this foot is pushing off, is much easier and comes much closer to a natural motion of the joint, due to its pivoting about the slant axis 1, especially when compared to pivoting about the axis 6 or an axis parallel thereto through the boot-toe 17. It shows that arranging the axis according to the DE-OS No. 33 15 641, as mentioned in the introduction, which runs from inside - top - forwards towards the outside - bottom - rearwards, is hardly suitable for the skating step.

The axes 1 together with the longitudinal axis of the boot, when they are projected on the ski surface, preferably enclose an angle of 70° to 86°, and with the ski surface they preferably make an angle of 5° to 20°.

FIGS. 4 through 7 show a first embodiment. A right boot 2 is equipped with a thickened sole 12 which has a free web 20 on both sides in the toe area. This web is centered across the width of the cross-country ski. The web 20 has a boring 13 through which runs the axis 1, and into which an axle bolt 10 is inserted. The latter has three-edged round sections which protrude on both sides. The web 20 rises skewed towards the boot-toe 17 so that, according to FIG. 6, a wedge-shaped space towards the binding element 3 remains free. A damping element 19, belonging to the boot 2 or to the binding element 3, and consisting of foam rubber or a similar elastic, slightly compressible material is inserted. The boot 2 thus can be pivoted about the axis 1 against a slight resistance. The binding element 3 has two parallel longitudinal slides 21 which can be activated through a swivelling lever 23, and whose rearward ends have tongues 22. V-shaped recesses 24 are situated in the slide guide 25, and the protruding end sections of the axle bolt 10 are inserted therein. After the lever 23 is activated, the tongues 22 grip over the end sections and fasten cylindrical axle bolts 10 within the web 20 on the binding element 3. The boot 2 preferably has a sole 12 which is stiff with respect to roll-off and torsion. The boot is thus pivotably connected with the ski 7 about the axis 1. As can be seen from FIG. 7, a stop 18, adjustable by a screw 27, is provided in the binding element 3. This stop limits the lift-off angle of the boot 2.

Figure 8:
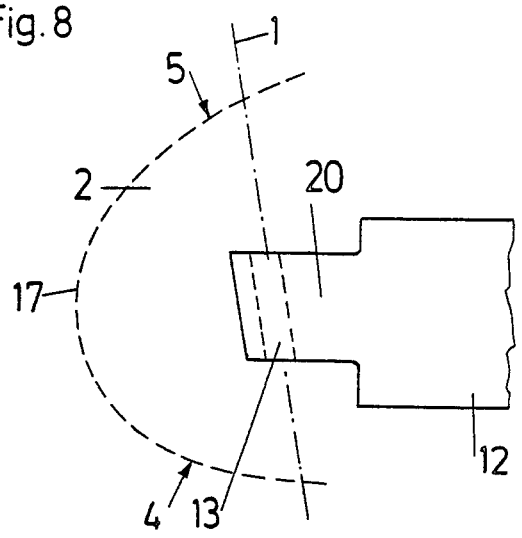
FIG. 8 shows a schematic top view of a forward boot section of a right boot according to FIG. 5 in a second embodiment.
Figure 9:
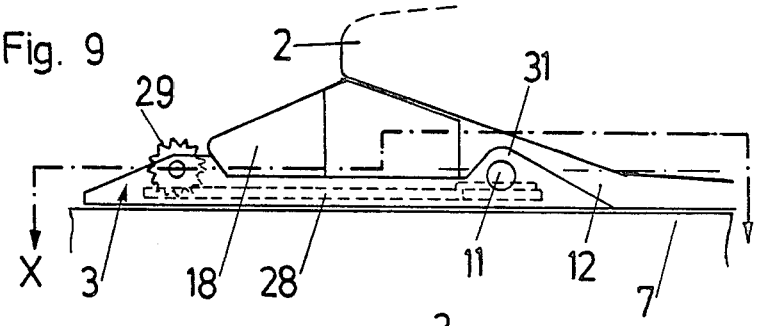
FIG. 9 shows a side view of the second embodiment corresponding to FIG. 6.
Figure 10:
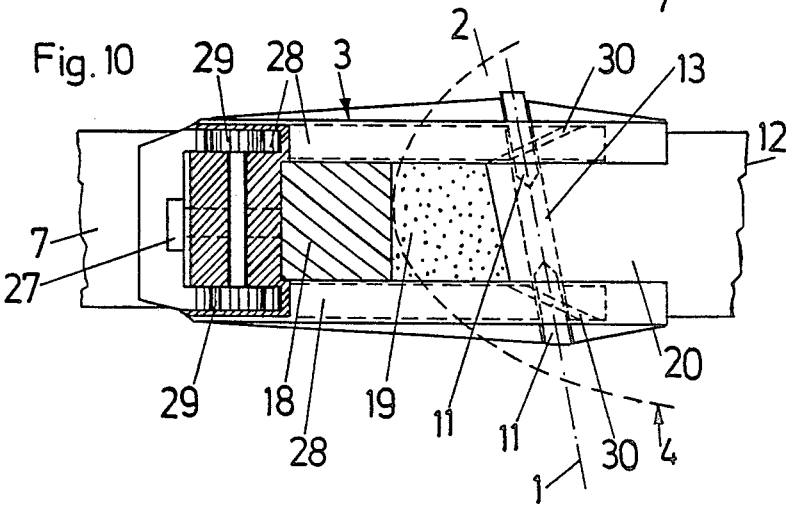
FIG. 10 shows a top view of the second embodiment corresponding to FIG. 7.

According to FIGS. 8 through 10, the web 20 of the sole 12 has the boring 13 which is coaxial with the axis 1, and the axle bolt is formed by two semi-axles 11 which are movably mounted in the axis 1 in the binding element 3. When the boot 2 is inserted, they are partially pushed into the boring 13 from both sides. In place of the boring 13, therefore, two blind borings can also be formed. According to FIGS. 9 and 10, longitudinal slides 28 are conducted along the binding element 3. These slides are at least partly formed as toothed rods. Toothed activation wheels 29 engage the slides 28 at their forward ends. At the rearward end section, each longitudinal slide 28 has a slanted carrier web 30 which engages a counterpart recess in the semi-axle 11. These can be moved in the guide 31 of the binding element 3 coaxial to the axis 1. When the longitudinal slide 28 is activated, the semi-axles 11 are then pushed into or out of the boring 13.

Figure 11:
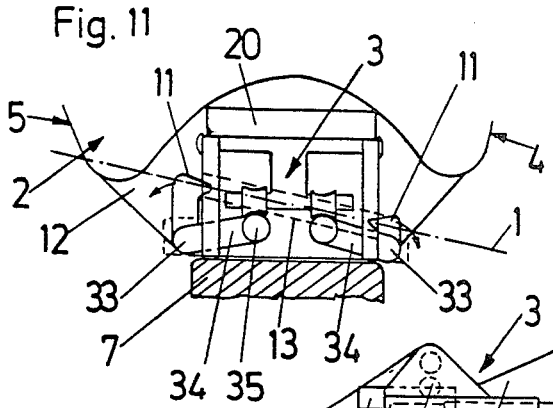
FIG. 11 shows a front view of a boot according to FIG. 8 with a binding element of a third embodiment.
Figure 12:
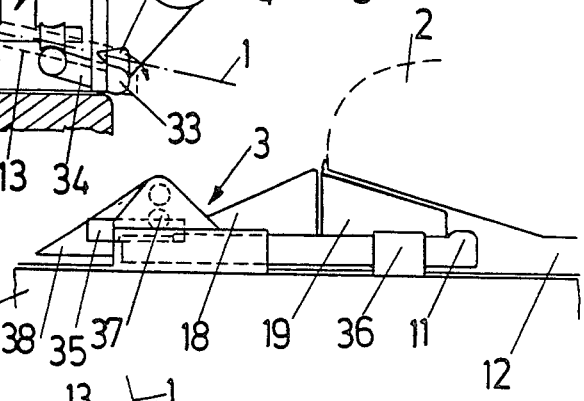
FIG. 12 shows a side view of the third embodiment corresponding to FIGS. 6 and 9.
Figure 13:
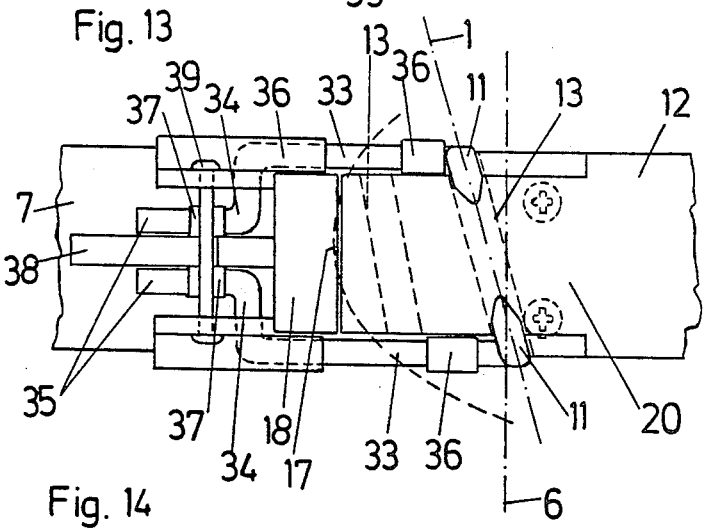
FIG. 13 shows a top view of the third embodiment corresponding to FIGS. 7 and 10.

In the embodiment according to FIGS. 11 through 13, a boot 2 is again used, whose sole web 20 has a boring 13, into which the two semi-axles 11 can be swung. For this purpose, a lever mechanism is provided in the binding element 3. This lever mechanism can be activated by means of a toggle lever 38. The latter can pivot about an axis 39 and has two rolls 37, each of which presses against a leg 35 of a swiveling lever 33, which is connected to the leg 35 through a cross-arm 34. Every swiveling lever 33 is rotatable in binding-fast bearings 36. The semi-axle 11, which laterally swings into the boring 13, is disposed at the high rear end. FIG. 13 also indicates the possibility that the sole web 20 has at least one other boring 13 with a different slant, in the region between the imagined rotation axis 6 of the toe joints and the boot-toe 17. For this case, variously long swiveling levers 33 are preferably also provided, which are exchangable, so that a larger number of positions and directions of the axis 1 can be achieved.

Figure 14:
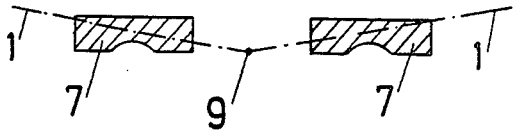
FIG. 14 shows a pivoting axle arrangement corresponding to FIG. 2, where the axles go through the pair of skis.
Figure 15:
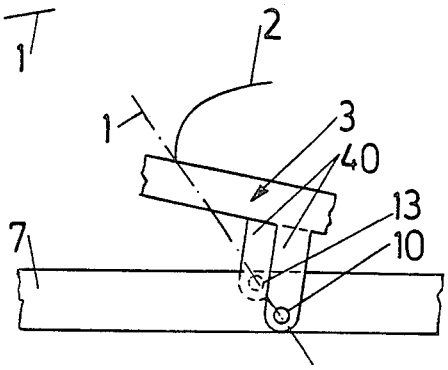
FIG. 15 shows a schematic side view of the embodiment according to FIG. 13.

In the previously described embodiments, the axes 1 always run through the sole 12. FIGS. 14 and 15 show a schematic representation of an embodiment in which the axes 1 run through the ski 7. The binding element 3, which is not shown in more detail, receives a boot 2. It has downwardly extending tabs 40 or the like, which are pivotably disposed laterally on the ski 7. Here the ski can be penetrated by the outwardly extending axle bolts 10, or else the two semi-axles disposed on the tabs 40 can be inserted into the borings 13 of the ski. Here too, various positions can be achieved if, for example, several borings are formed in the ski 7.

With the use of the converging axes 1, the conventional flexible design of the boot-sole 12 is no longer required, but it can be designed rigidly, at least from the pivoting region to the heel 16. As a result, the thickness of the sole can be arbitrary. A sole 12 which is stiff with respect to roll-off and twisting also improves the hold in the binding element. This is especially important in the case of the skating step, so that the heel guiding parts can be obviated.

I claim:

1. A device, including a binding element, for fastening a cross-country ski boot on one of a pair of cross-country skis comprising a pivoting axis, converging with a similar pivoting axis from the device from the mate of the pair of cross-country skis, each pivoting axis running at a slant with respect to a longitudinal direction of each ski, from an intersection point at which said pivoting axis and said similar pivoting axis from the device from a mate of the pair of cross-country skis converge, said intersection point being at the inside of said cross-country ski boot, through a point at the outside of said cross-country ski boot, said outside point being closer to the tip of the ski than the intersection point of the pivoting axes.

2. The device according to claim 1 comprising an imagined rotation axis of the toe joint of the foot which is situated in the cross country ski, said imagined rotation axis lying approximately at a center of gravity in the middle of the ski, such that said pivoting axis runs in a region below said imagined rotation axis.

3. The device according to claim 1 wherein the pivoting axis, when projected on the ski surface, runs at an angle between 70 degrees and 86 degrees with respect to said longitudinal direction of the ski.

4. The device according to claim 1 wherein the pivoting axis rises toward said outside point at an angle between 5 degrees and 20 degrees to the ski surface.

5. The device according to claim 1 wherein the pivoting axis comprises an axle bolt, each axle bolt comprising two semi-axles, which are movably disposed in the device and are insertable into a boring which is flush with the pivoting axis.

6. The device according to claim 5 wherein the semi-axles are movably disposed in an angular region between 70 degrees and 86 degrees with respect to the longitudinal direction of the ski, to result in an engagement between the ski boot and the ski binding.

7. The device according to claim 5, wherein the semi-axles are disposed in lateral guides and are insertable into the boring.

8. The device according to claim 5 wherein the semi-axles are hinged at the binding element and are swingable into the boring.

9. The device according to claim 1 wherein the sole of the cross-country boot comprises a stiff material so as to be stiff against roll-off.

10. The device according to claim 1 wherein the sole of the cross-country boot comprises a stiff material so as to be stiff against torsion.

11. The device according to claim 2 wherein the sole of the cross-country ski boot comprises a material stiff against roll-off and torsion from the heel to the pivoting axis, and comprises a flexible material from the pivoting axis to the forward boot toe.

12. The device according to claim 1 further comprising a stop means for limiting the upward movement of the heel part of the cross-country ski boot, said stop means being preferably adjustable.

13. The device according to claim 1 further include means for disposing the pivoting axis in several positions in the region between the boot-toe and the imagined rotation axis of the toe joints.

* * * * *